US005558337A

United States Patent [19]

Frank, III

[11] Patent Number: 5,558,337

[45] Date of Patent: Sep. 24, 1996

[54] DART BOARD GOLF GAME

[76] Inventor: Louis C. Frank, III, 3405 Andover Dr., Fairfax, Va. 22030

[21] Appl. No.: 529,331

[22] Filed: Sep. 18, 1995

[51] Int. Cl.[6] ..... F41J 3/00

[52] U.S. Cl. ..... 273/408; 273/317.2

[58] Field of Search ..... 273/408, 409, 273/87 R, 87 G, 403, 404

[56] References Cited

U.S. PATENT DOCUMENTS

| | | | |
|---|---|---|---|
| 3,989,249 | 11/1976 | Breslow | 273/87 R |
| 5,020,807 | 6/1991 | Barkley | 273/409 |
| 5,118,116 | 6/1992 | Cherni | 273/408 |
| 5,197,743 | 3/1993 | Hanson, Jr. | 273/408 |

*Primary Examiner*—Mark S. Graham

[57] ABSTRACT

A dart board golf game adapted for use in association with a regulation size dart board including numbered sectional areas and regulation size darts, the dart board golf game comprising: a plurality of score cards formed in a planar configuration, the score cards including a plurality of columns and rows, a first column including the numerals 1 through 9 and 10 through 18, a second combination column including a listed sequence of numerals representing numbered sectional areas of a regulation dart board; and a set of playing rules informing players how to play the game, each player being required to score dart hits in the sectional areas of the dart board corresponding to the numerals in the combination column on the playing card, the player achieving the lowest score at the completion of the game being deemed the winner.

1 Claim, 2 Drawing Sheets

FIG. 3
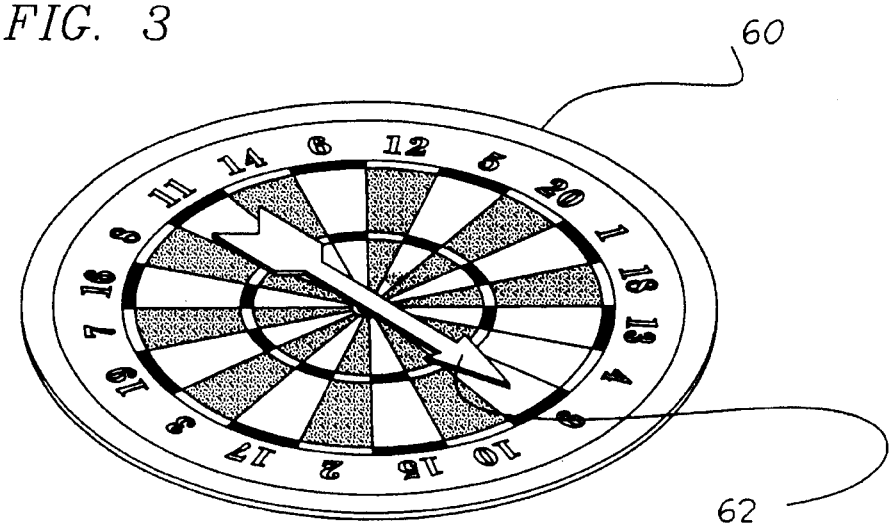
FIG. 4
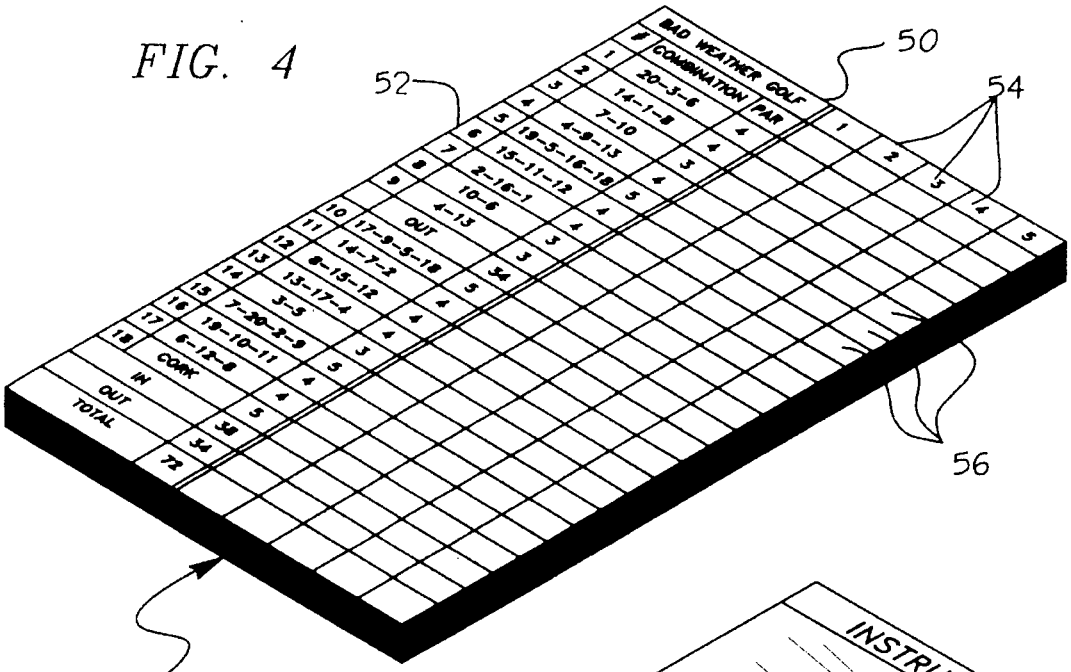
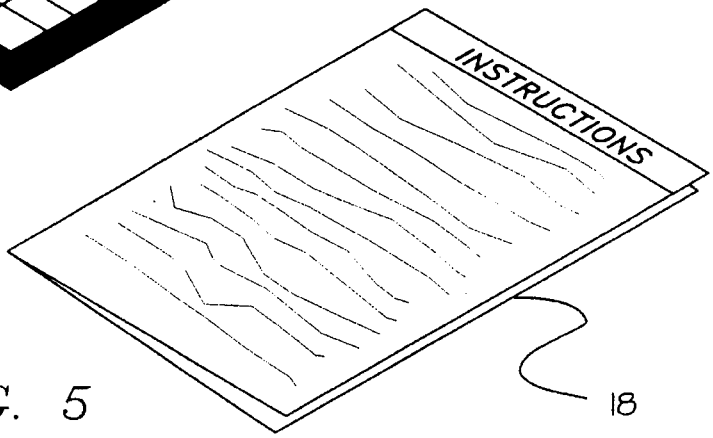
FIG. 5

DART BOARD GOLF GAME

BACKGROUND OF THE INVENTION

1. Field of the Invention

The present invention relates to a dart board golf game and more particularly pertains to assessing one's dart throwing accuracy by scoring hits in the order required by the scoring card.

2. Description of the Prior Art

The use of dart games is known in the prior art. More specifically, dart games heretofore devised and utilized for the purpose of entertaining users by playing the games in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,197,743 to Hanson a golfing dart game apparatus.

U.S. Pat. No. 3,697,073 to Dooley discloses a golf photography dart board including scene changing means.

U.S. Pat. No. 5,092,600 to Ruth discloses an indooroutdoor golf course.

U.S. Pat. No. 5,020,807 to Barkley discloses a projectile board.

U.S. Pat. No. 3,997,162to Scullin discloses a dart board game.

Lastly, U.S. Pat. No. 3,979,117 to Worsham discloses a football dart board game.

In this respect, the dart board golf game according to the present invention substantially departs from the conventional concepts and designs of the prior art, and in doing so provides an apparatus primarily developed for the purpose of assessing one's dart throwing accuracy by scoring hits in the order required by the scoring card.

Therefore, it can be appreciated that there exists a continuing need for a new and improved dart board golf game which can be used for assessing one's dart throwing accuracy by scoring hits in the order required by the scoring card. In this regard, the present invention substantially fulfills this need.

SUMMARY OF THE INVENTION

In view of the foregoing disadvantages inherent in the known types of dart games now present in the prior art, the present invention provides an improved dart board golf game. As such, the general purpose of the present invention, which will be described subsequently in greater detail, is to provide a new and improved dart board golf game and method which has all the advantages of the prior art and none of the disadvantages.

To attain this, the present invention essentially comprises a new and improved dart board golf game comprising, in combination: a regulation dart board formed in a planar generally circular configuration and adapted to be hung vertically from a mounting surface, the board having a circular cork center, the board having an outer ring positioned adjacent to the outer perimeter of the board, the board including three inner rings having a smaller width than the outer ring, a first inner ring being positioned around the cork center, a second inner ring being positioned adjacent to the outer ring, a third inner ring being positioned between the inner and outer rings, the outer ring including the numerals

1 through 20, in the operative orientation the numeral 20 being positioned at the top of the board with the remaining numerals being positioned around the outer ring in a clockwise sequence as follows: 1, 18, 13, 4, 9, 10, 15, 2, 17, 3, 19, 7, 16, 8, 11, 14, 6, 12 and 5, twenty generally triangular shaped sectional areas being positioned between the first and second inner rings of the dart board, each triangular shaped sectional area having an apex abutting the first inner ring of the dart board, the sections being formed of two different colors and arranged in an alternating color sequence, each individual numeral being positioned adjacent to a corresponding individual sectional area; a plurality of darts, each dart including a main body section formed in a generally cylindrical configuration with a front end and a rear end, the front end of each dart including a needle extending therefrom, the rear end of each dart including a plurality of feathers extending therefrom, the main section of each dart including a rough surface to enhance gripping by users, during play of the game the darts being thrown at the dart board so that the needle becomes lodged in a desired sectional area of the board; a plurality of score cards formed in a planar generally rectangular configuration with a right side, a left side, a horizontal top edge and a vertical left edge, each scorecard including a plurality of horizontal and vertical lines forming a plurality of columns and rows, the right side top edge including horizontally positioned numerals 1 through 5 to permit recording of scores of up to five players, a first column including the numerals 1 through 9 and 10 through 18 positioned vertically in ascending order, the vertically positioned numerals representing the front 9 holes and back 9 holes of a golf course, a second combination column including sets of between two and four numerals separated by dashes, the numeral sets representing the order in which players must score dart hits on the corresponding sectional areas of the dart board in order to move on to the next numeral in the first column, a third par column being positioned adjacent to the combination column, the par column including the numerals 3, 4 or 5 to represent the par number of throws expected to achieve the hits required in the combination column, each player recording their respective scores with each combination being achieved; and a set of playing rules informing players how to play the game, each player being required to stand a predetermined distance from the dart board when throwing the darts, each player being required to score dart hits in the sectional areas of the dart board corresponding to the numerals in the combination column on the playing card, the combination 20–3–6 indicating that players must score hits in the following sequence: section 20, section 3 and section 6, the players continuing to throw darts until attaining the required combination or reaching a maximum score of 12 throws, the player achieving the lowest score at the completion of the game being deemed the winner.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart board golf game which has all of the advantages of the prior art dart games and none of the disadvantages.

It is another object of the present invention to provide a new and improved dart board golf game which may be easily and efficiently manufactured and marketed.

It is further object of the present invention to provide a new and improved dart board golf game which is of durable and reliable constructions.

An even further object of the present invention is to provide a new and improved dart board golf game which is susceptible of a low cost of manufacture with regard to both materials and labor, and which accordingly is then susceptible of low prices of sale to the consuming public, thereby making such dart board golf game economically available to the buying public.

Still yet another object of the present invention is to provide a new and improved dart board golf game which provides in the apparatuses and methods of the prior art some of the advantages thereof, while simultaneously overcoming some of the disadvantages normally associated therewith.

Still another object of the present invention is to assessing one's dart throwing accuracy by scoring hits in the order required by the scoring card.

Lastly, it is an object of the present invention to provide a new and improved dart board golf game adapted for use in association with a regulation size dart board including numbered sectional areas and regulation size darts, the dart board golf game comprising: a plurality of score cards formed in a planar configuration, the score cards including a plurality of columns and rows, a first column including the numerals 1 through 9 and 10 through 18, a second combination column including a listed sequence of numerals representing numbered sectional areas of a regulation dart board; and a set of playing rules informing players how to play the game, each player being required to score dart hits in the sectional areas of the dart board corresponding to the numerals in the combination column on the playing card, the player achieving the lowest score at the completion of the game being deemed the winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective illustration of an alternative embodiment of the dart board golf game illustrating a dart board with a spinable arrow mounted centrally thereupon.

FIG. 4 is a perspective illustration of the scoring card of the dart board golf game.

FIG. 5 is a perspective illustration of the set of playing rules of the dart board golf game. The same reference numerals refer to the same parts through the various Figures.

DESCRIPTION OF THE PREFERRED EMBODIMENT

Figure 1:
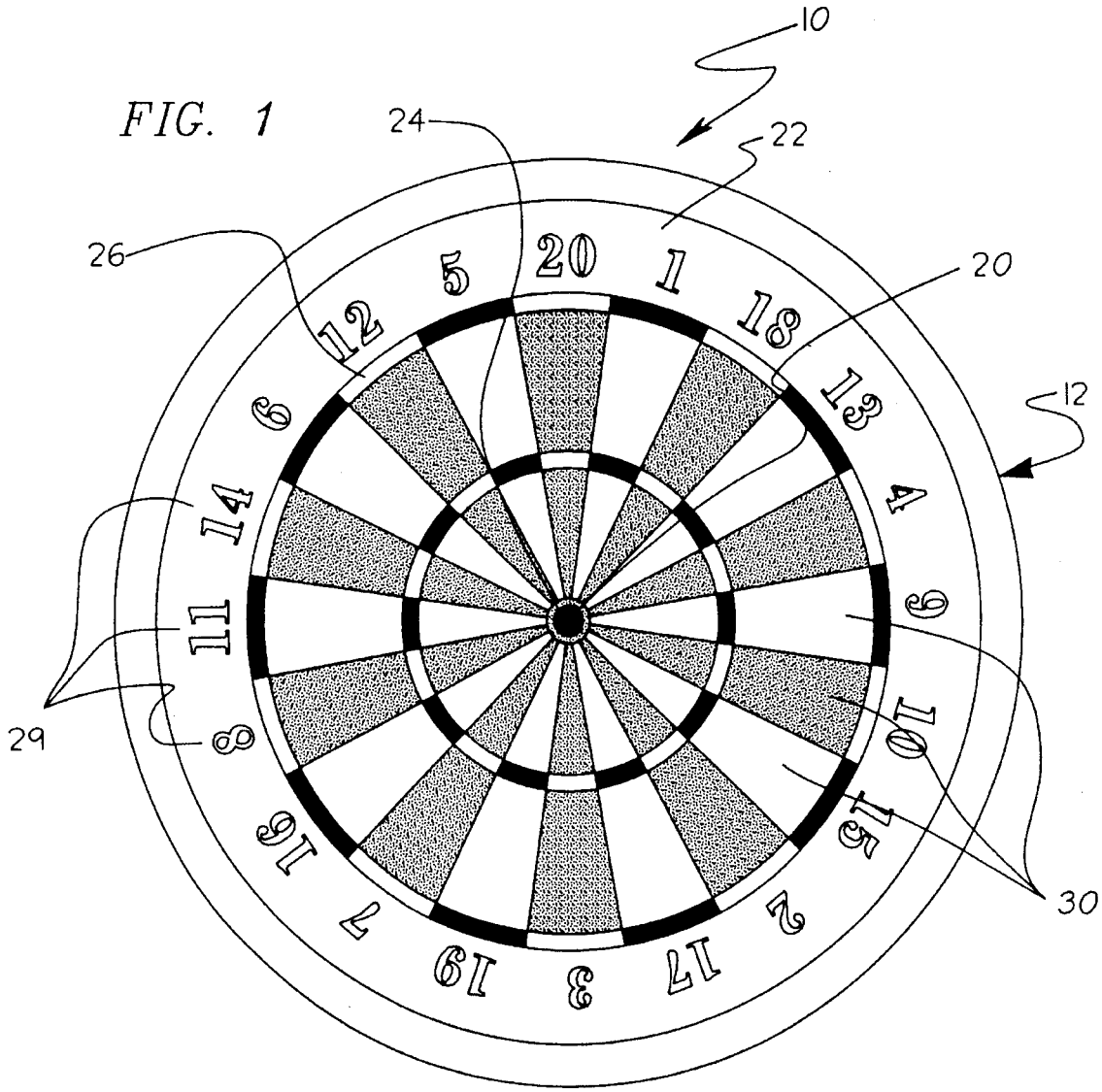
FIG. 1 is a perspective view of the preferred embodiment of the dart board golf game constructed in accordance with the principles of the present invention.

With reference now to the drawings, and in particular to FIG. 1 thereof, the preferred embodiment of the new and improved dart board golf game embodying the principles and concepts of the present invention and generally designated by the reference numeral 10 will be described.

The present invention, the dart board golf game 10 is comprised of a plurality of components. Such components in their broadest context include a regulation dart board 12, a plurality of darts 14, score card 16 and a set of playing rules 18. Such components are individually configured and correlated with respect to each other so as to attain the desired objective.

More specifically, the regulation dart board 12 is formed in a planar generally circular configuration. The board has a thickness between about ½ inch and 2 inches. The board is adapted to be hung vertically from a mounting surface such as a wall or, alternatively, hung in a dart cabinet. The board has a circular cork center 20. The board has an outer ring 22 positioned adjacent to the outer perimeter of the board. Note FIG. 1.

The board includes three inner rings which have a smaller width than the outer ring. A first inner ring 24 is positioned around the cork center. A second inner ring 26 is positioned adjacent to the outer ring. In one embodiment of the apparatus, a thin circular metal rod encircles the second inner ring. A third inner ring 28 is positioned between the inner and outer rings. The second and third inner rings have a different color than the sectional area that they are positioned upon. This allows the players to more easily identify their dart hits. Note FIG. 1.

The outer ring includes the numerals one through twenty 29, in a non-consecutive fashion. In the operative orientation, the numeral 20 is positioned at the top of the board with the remaining numerals being positioned around the outer ring in a clockwise sequence as follows: 1, 18, 13, 4, 9, 10, 15, 2, 17, 3, 19, 7, 16, 8, 11, 14, 6, 12 and 5. Note FIG. 1.

Twenty generally triangular shaped sectional areas 30 are positioned between the first and second inner rings of the dart board. Each triangular shaped sectional area has an apex abutting the first inner ring of the dart board. The sectional areas are formed of two different colors and arranged in an alternating color sequence. Each individual numeral is positioned adjacent to a corresponding individual sectional area. During play, each player is required to throw darts at the numbered sectional area corresponding to the number sequence indicated in the combination column of the scorecard. Note FIGS. 1 and 4.

Figure 2:
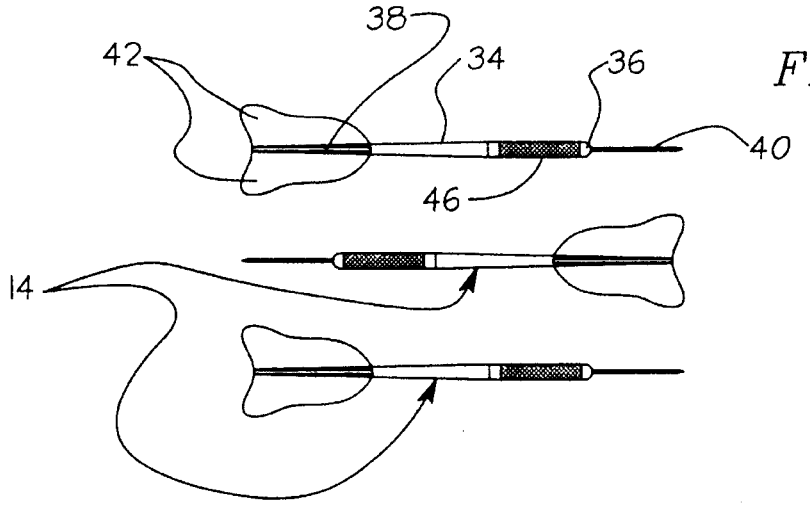
FIG. 2 is an isolated perspective view of the darts of the dart board golf game.

A plurality of darts 14 are included with the apparatus. Each dart has a main body section 34 formed in a generally cylindrical configuration with a front end 36 and a rear end 38. The front end of each dart includes a needle 40 extending from it. The rear end of each dart includes a plurality of feathers 42 extending from it. In alternative embodiments of the apparatus, a plurality of different natural and synthetic materials could be affixed to the rear end creating a tail. The main section 34 of each dart includes a rough surface 46 to enhance gripping by users. The rough section consists of a plurality of cross-crossed ridges. During play of the game, the darts are thrown at the dart board so that the needle becomes lodged in a desired sectional area of the board. Note FIGS. 1 and 2.

A plurality of score cards 16 are formed in a planar generally rectangular configuration with a right side, a left side, a horizontal top edge 50 and a vertical left edge 52. In the preferred embodiment, the score cards are fabricated of heavy stock paper. Each score card includes a plurality of horizontal and vertical lines forming a plurality of columns 54 and rows 56. The right side top edge includes the numerals 1 through 5 to permit recording of scores of up to five players. In an alternative embodiment the score card includes additional columns to permit play by more than five players. Note FIG. 4.

A first edge includes the numerals 1 through 9 and 10 through 18 positioned vertically in ascending numerical order. A space is included between the first and second set of nine numerals to permit subtotaling of the score at the midpoint of the game. The numerals represent the front 9 holes and the back 9 holes of a golf course. A second combination column includes sets of between two and four numerals separated by dashes. The numerals represent the order in which players must score hits on the corresponding sectional areas of the dart board in order to move on to the next hole in the first column. In an alternative embodiment of the apparatus, players may score hits in any order desired at each hole. Note FIG. 4.

A third column is positioned adjacent to the combination column and represents the par column. The par column includes the numerals 3, 4 or 5 to represent the par number of throws expected to achieve the hits required in the combination column. Each player records their respective scores when each combination is achieved. The player achieving the lowest score at the end of the game is deemed the winner. Note FIG. 4.

A set of playing rules 18, inform the players how to play the game. Each player is required to stand a predetermined distance from the dart board when throwing the darts. Each player is required to score hits in the sections of the dart board corresponding to the numerals in the combination column on the playing card. For example, the combination 20–3–6 indicates that players must score hits in the following sequence: sectional area 20, sectional area 3 and sectional area 6. The players continue to throw their darts until they attain the required combination or reach a maximum allowable attempts of 12 throws. In the preferred embodiment, five players may participate at one time. After completion of the eighteen holes, the game ends. The player who achieves the lowest score at the completion of the game is deemed the winner. Note FIGS. 1, 2 and 4.

In an alternative embodiment of the apparatus a planar circular shaped supplemental board 60 is included. The supplemental board includes the indicia, numerals and design of a regulation dart board. The supplemental board has an arrow shaped spinner 62 which is rotatably coupled to the center point of the supplemental board. The supplemental board is positionable upon a horizontal or vertical mounting surface. The supplemental board allows users to spin the arrow shaped spinner three times to randomly determine additional number combinations to be used in place of the score card number combinations. The spinner is used when players are tired of using the standard number combinations, thereby allowing them to effectively "change the golf course." Note FIG. 3.

The dart board golf game provides players with an enjoyable method of practicing and developing their dart throwing accuracy. The apparatus is designed for a plurality of players. First, a player sequence is determined by having everyone shoot at the bull's eye. The closest player goes first, and then the next closest, etc. When playing with more than five players, a simple draw from a hat can determine the order. After the order is determined, the player names are written in the appropriate order on the score card. Now you are ready to tee off at the first hole.

During play of the game each dart counts one stroke. By each hole numeral is a "combination" of numbers that represent the numerals on a dart board. A turn consists of completing the hole to its entirety. Each player in turn continues to shoot at the "combination" numbers until they are all hit or the maximum score of twelve strokes is counted. Throwing three darts four times is the maximum a player can take per hole.

Scoring the game takes place as follows: Hole Number 1 means you must hit a 20, then a 3, then a 6 in that order to complete the hole. Now if a player takes six darts (strokes) to hit the "combination" numbers, then a 6 is recorded on the provided score card, and the next player takes their turn. At the end of 18 holes the players add up their respective scores. The lowest scoring player is deemed the winner. Players of all ages can have great fun with the apparatus. The game may be played by individually or as part of a 30-person tournament.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved dart board golf game comprising, in combination:

a regulation dart board formed in a planar generally circular configuration and adapted to be hung vertically from a mounting surface, the board having a circular cork center, the board having an outer ring positioned adjacent to the outer perimeter of the board, the board including three inner rings having a smaller width than the outer ring, a first inner ring being positioned around the cork center, a second inner ring being positioned adjacent to the outer ring, a third inner ring being positioned between the inner and outer rings, the outer ring including the numerals 1 through 20, in the operative orientation the numeral 20 being positioned at the top of the board with the remaining numerals being positioned around the outer ring in a clockwise sequence as follows: 1, 18, 13, 4, 9, 10, 15, 2, 17, 3, 19, 7, 16, 8, 11, 14, 6, 12 and 5, twenty generally triangular shaped sectional areas being positioned between the first and second inner rings of the dart board, each triangular shaped sectional area having an apex abutting the first inner ring of the dart board, the sections being formed of two different colors and arranged in an alternating color sequence, each individual numeral being positioned adjacent to a corresponding individual sectional area;

a plurality of darts, each dart including a main body section formed in a generally cylindrical configuration with a front end and a rear end, the front end of each dart including a needle extending therefrom, the rear end of each dart including a plurality of feathers extending therefrom, the main section of each dart including a rough surface to enhance gripping by users, during play of the game the darts being thrown at the dart board so that the needle becomes lodged in a desired sectional area of the board;

a plurality of score cards formed in a planar generally rectangular configuration with a right side, a left side, a horizontal top edge and a vertical left edge, each scorecard including a plurality of horizontal and vertical lines forming a plurality of columns and rows, the right side top edge including horizontally positioned numerals 1 through 5 to permit recording of scores of up to five players, a first column including the numerals 1 through 9 and 10 through 18 positioned vertically in ascending order, the vertically positioned numerals representing the front 9 holes and back 9 holes of a golf course, a second combination column including sets of between two and four numerals separated by dashes, the numeral sets representing the order in which players must score dart hits on the corresponding sectional areas of the dart board in order to move on to the next numeral in the first column, a third par column being positioned adjacent to the combination column, the par column including the numerals 3, 4 or 5 to represent the par number of throws expected to achieve the hits required in the combination column, each player recording their respective scores with each combination being achieved; and a set of playing rules informing players how to play the game, each player being required to stand a predetermined distance from the dart board when throwing the darts, each player being required to score dart hits in the sectional areas of the dart board corresponding to the numerals in the combination column on the playing card, the combination 20–3–6 indicating that players must score hits in the following sequence: section 20, section 3 and section 6, the players continuing to throw darts until attaining the required combination or reaching a maximum score of 12 throws, the player achieving the lowest score at the completion of the game being deemed the winner.

* * * * *